United States Patent [19]

Yasuhara

[11] 4,403,582

[45] Sep. 13, 1983

[54] FUEL INJECTION CONTROL SYSTEM

[75] Inventor: Seishi Yasuhara, Yokosuka, Japan

[73] Assignee: Nissan Motor Company, Limited, Kanagawa, Japan

[21] Appl. No.: 277,818

[22] Filed: Jun. 26, 1981

[30] Foreign Application Priority Data

Sep. 10, 1980 [JP] Japan ..... 55-124639

[51] Int. Cl.[3] ..... F02D 31/00

[52] U.S. Cl. ..... 123/357; 123/503

[58] Field of Search ..... 123/357, 358, 359, 449, 123/503

[56] References Cited

U.S. PATENT DOCUMENTS

| | | | |
|---|---|---|---|
| 3,630,643 | 12/1971 | Eheim et al. | 417/289 |
| 3,841,286 | 10/1974 | Eheim | 123/357 |
| 4,192,398 | 3/1980 | Hunt | 123/357 |
| 4,318,378 | 3/1982 | Eheim | 123/357 |
| 4,325,337 | 4/1982 | Eheim et al. | 123/357 |
| 4,345,563 | 8/1982 | Eheim | 123/458 |

FOREIGN PATENT DOCUMENTS

| | | |
|---|---|---|
| 1075445 | 7/1967 | United Kingdom . |
| 1287822 | 9/1972 | United Kingdom . |
| 1462872 | 1/1977 | United Kingdom . |

OTHER PUBLICATIONS

Straubel et al, Distributor Injection Pump, 8/1/1979, an Asme Publication.

*Primary Examiner*—Ira S. Lazarus
*Assistant Examiner*—Magdalen Moy
*Attorney, Agent, or Firm*—Lowe, King, Price & Becker

[57] ABSTRACT

A fuel injection pump, for internal combustion engines, wherein a fuel distributing plunger moves angularly and axially in synchronism with the rotation of the engine and which cooperates with a control sleeve which determines the beginning or termination of injection into the cylinders. The control sleeve is controlled by an electrical motor through the motor's rotating shaft which is biased by an urging device circumferentially. The motor shaft is rotated to a predetermined position where the amount of injected fuel becomes small enough to keep engine operation safe if the motor output force exerted on the motor shaft disappears owing to a defect occurring.

7 Claims, 3 Drawing Figures

FUEL INJECTION CONTROL SYSTEM

BACKGROUND OF THE INVENTION

The present invention relates to fuel injection control systems for internal combustion engines, such as Diesel engines, and more particularly to electrically controlled fuel injection pumps wherein a safety device is provided to reduce the amounts of injected fuel if a defect arises in the control system.

SUMMARY OF THE INVENTION

It is an object of this invention to provide an electrically controlled fuel injection pump for internal combustion engines which reduces the amount of injected fuel into the engine cylinders if a defect occurs in the electric part thereof so as to prevent a vehicle driven by the engine running away or to keep the engine operation safe.

The present invention provides a fuel injection pump for internal combustion engines, such as Diesel engines, wherein an electric motor operates a control sleeve cooperating with a fuel displacing and distributing plunger to determine the termination of fuel admission into the engine cylinders and thus to control the amount of injected fuel. A slider and a linkage are provided between the motor's rotating shaft and the control sleeve to change the orientation of the driving force from the motor and transmit it to the control sleeve. The motor could be controlled in response to the output power required for the engine. The slider engages with the motor output shaft to change the rotational movement thereof to linear movement. The linkage engages with the slider through a connecting member and the control sleeve to transmit the linear driving force from the slider to the sleeve. The control sleeve is of cylindrical shape and is mounted slideably on the plunger. The sleeve is designed in such a manner that the axial movement thereof varies the termination of fuel admission, controlling the amount of fuel injected into the engine cylinders. Thus, as the motor rotates in response to the output power required for the engine, the control sleeve moves linearly and consequently the amount of injected fuel varies.

Additionally, the pump contains an urging device rotating the motor shaft to a predetermined position, if the motor output force exerted on the motor shaft disappears owing to a defect occuring, thus ensuring that an amount of fuel small enough to keep the engine running safely or to prevent the vehicle driven by the engine from running away is injected.

BRIEF DESCRIPTION OF THE DRAWINGS

The above and other objects, features and advantages of the present invention will be apparent from the following description of preferred and alternative embodiments thereof, taken in connection with the drawings in which the same reference numerals designate corresponding parts throughout the drawings and in which.

DETAILED DESCRIPTION OF THE EMBODIMENTS

Figure 1:
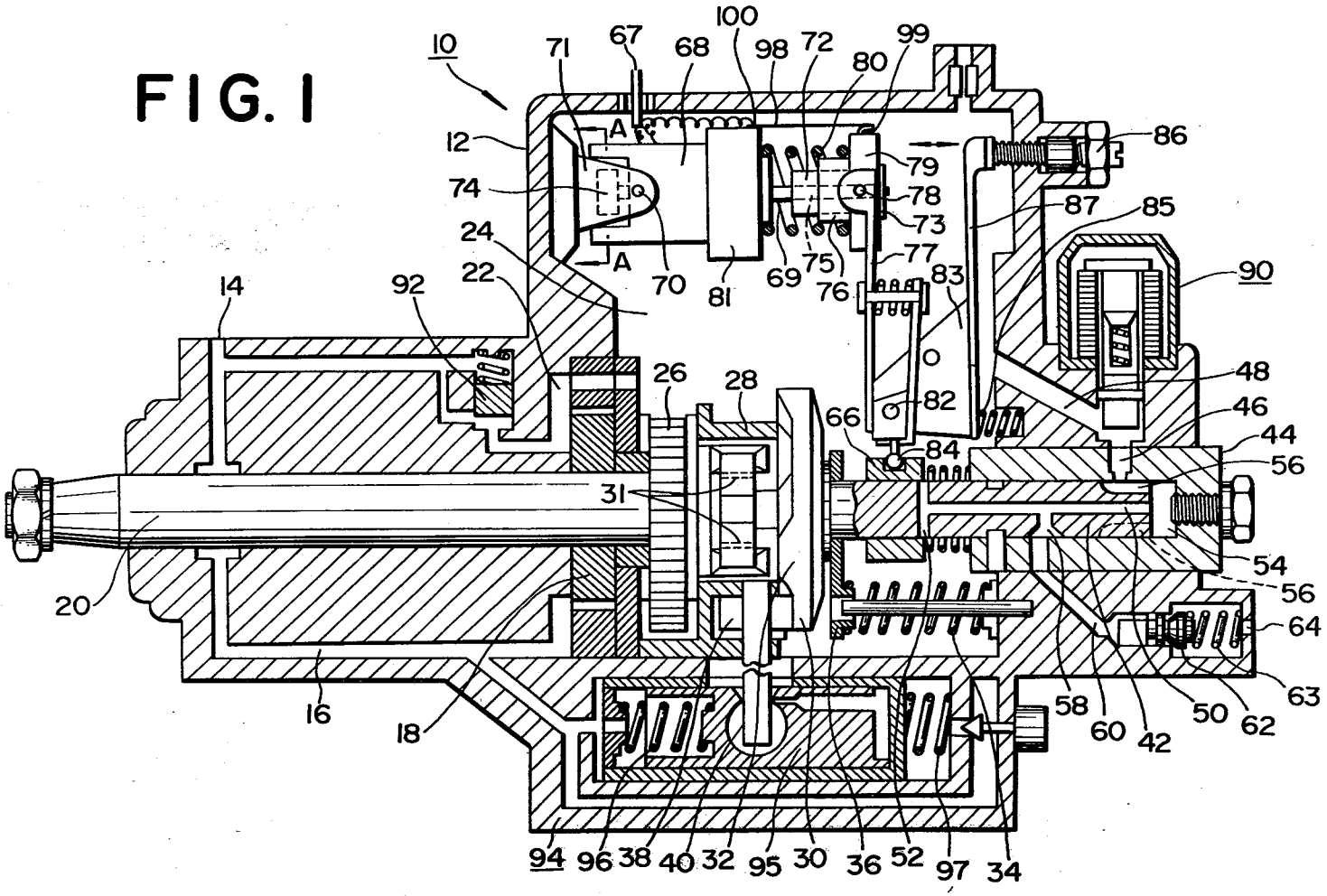
FIG. 1 is a diagrammatic sectional view of a preferred embodiment of a fuel injection system according to the present invention.

Referring to the drawings and particularly to FIG. 1, there is shown a preferred embodiment of a fuel injection control system according to the present invention, generally designated by reference numeral 10. The system includes a housing 12 with a fuel inlet 14 and a fuel passageway 16 communicating therewith. A rotary feed pump 18 is enclosed within the housing 12 which is driven by a drive shaft 20, and is coupled with the crankshaft to supply fuel admitted from the inlet 14 through the passage 16 and another passage 22 to a chamber 24 formed within housing 12. A disc 26 is fixed to one end of the drive shaft 20 and supports a cylindrical member 28 such that this cylindrical member can rotate about the axis of the drive shaft 20 relative to the disc 26. A cam disc 30 is attached by keys 31 to the drive shaft in such a manner that it can easily move axially along the drive shaft but that it rotates together with the drive shaft. The cam disc has a plurality of cam faces 32 whose number corresponds to the number of engine cylinders. The cam disc is urged toward the cylindrical member 28 by a biasing plate 36 and plunger spring 34. The cam disc reciprocates axially by a predetermined amount of cam lift when each cam face passes over a roller 38 pivoted by a connecting rod 40 to the cylindrical member 28 as the cam disc is rotated by the drive shaft 20.

A fuel supply plunger 42 secured to the cam disc 30 rotates with the drive shaft 20 in a cylinder 44 secured to the housing 12, and moves axially with the axial motion of the cam. Cylinder 44 is provided with an intake port 46 in communication with chamber 24 through a fuel supply passage 48. The plunger 42 is provided with a central axial passage 50 and a spill port 52 communicating therewith, extending transversely from the plunger 42 to release the pressure from a high pressure chamber 54 formed by the plunger 42 and the cylinder 44. The plunger 42 has therein intake grooves 56 through which the intake port 46 and the high pressure chamber 54 communicate according to the phase of the plunger 42, and a distributor port 58 communicating with the central passage 50 and opening onto the side surface of the plunger. Fuel under pressure is introduced from the distributor port 58 to one of a plurality of output passages 60 provided in the housing 12 to a corresponding delivery valve 62, overcoming the return force of a spring 63 in the housing 12, and passing through a fuel outlet 64 to an injection nozzle, not shown.

A control sleeve 66 is slideably mounted on the plunger 42 which controls the opening of the spill port 52. When the sleeve 66 moves axially away from the disc 30, the opening timing of the port 52 is retarded and therefore the amount of injected fuel is increased.

An electric motor 68, which could be of a reversible DC type, driven by an external signal provided through leads 67, is supported at a point 70 on each side of the motor by a bracket 71 fixed to the inner wall surface of the housing 12. The motor 68 has an output shaft 69 which projects through the end walls of the motor. One end of the output shaft 69 is threaded and engages with a slider 72, and its other end is coupled to an urging device 74 as described hereinafter. The motor operates at a rate proportional to the electrical energy with which it is supplied, its direction of rotation determined by the sign of the current.

The slider 72 takes the form of a cylinder with a flange 73 at its outer end and includes an axial threaded hole 75 at its center into which the threaded motor shaft end is inserted to engage with the slider. A connecting member 76 of cylindrical force is slideably mounted on the slider 72 and engages with the same through a key connection (not shown) so that relative movement may occur axially between the slider 72 and the connecting member 76 until the connecting member meets the slider flange 73. Since the connecting member 76 is supported by a linkage 77 through a pin 78 so as not to rotate and the slider 72 also can not rotate, the member 76 moves toward or away from the motor along the output shaft 69 as the shaft rotates.

The connecting member 76 has a flange 79 at its outer end which receives a return spring 80, which is disposed between the shoulder of the flange and the end of an insulated solenoid 81 constructed integrally with the motor and which urges the connecting member against the slider flange 73. When the motor shaft 69 rotates to move the slider 72 toward the motor, the connecting member 76 moves with the slider against the spring 80 because the slider flange 73 pushes the end face of the connecting member toward the motor. When the motor shaft rotates reversely to move the slider away from the motor, the connecting member also moves with the slider because the return spring 80 pushes the connecting member away from the motor.

The linkage 77 is pivoted at 78 to the connecting member and at 82 to an adjustment plate 83, and is provided with a ball member 84 which engages with the control sleeve 66. When the slider 72 and the connecting member 76 move according to the rotation of the motor shaft 69, the linkage turns about the pivot 82, moving the control sleeve 66 axially, thereby varying the opening timing of the spill port 52 and hence the termination of fuel injection, namely the amount of injected fuel. The motor 68 could thus control the amount of injected fuel in response to the required engine output power.

The adjustment plate 83 is urged at its lower end toward the cam disc 30 by a spring 85 received in a recess in the housing 12 wall and is positioned so that adjustments can be made to the fuel injection amount by a screw 86 inserted into the housing 12 and fixed to an arm 87, the other end of which is fixed to the adjustment plate 83.

The connecting member 76 is made of magnetic material so that it can move, separately from the slider 72, toward the solenoid 81 against the return spring 80 by a predetermined distance, when the solenoid 81 is energized. Thus when, for instance, the solenoid is energized when the engine starts, the connecting member 76 moves the control sleeve 66 away from the disc 30 through the linkage 77, increasing the amount of injected fuel by a predetermined value to ensure that the engine starts.

A maximum fuel pressure limiting unit 90 closes the passage 48 when the fuel pressure in the passage 48 exceeds a predetermined value. A pressure control valve 92 controls the pressure of the fuel supplied from the pump 18 to the chamber 24.

A fuel injection timing control device 94 includes a plunger piston 95 operated by the pressure of fuel taken therein through the passage 16 and is urged to an initial position by a pair of springs 96, 97 disposed one on each side of the plunger. The connecting rod 40 connects the piston 95 and the cylindrical member 28 so that the cylindrical member 28 is rotated about the axis of the shaft 20 independently of the disc 26 by the movement of the piston 95. The piston 95 is moved axially in the casing according to the pressure of fuel from the feed pump 18 and turns the connecting rod 40 about the axis of the shaft 20 by a corresponding angle in order to adjust the timing of the axial movement of the plunger 42 which is caused by the roller 38 bearing on the cam faces of the cam disc 30, thereby controlling the timing of the fuel injection and the beginning of compression of fuel in the pressure chamber 54. To aid comprehension, the timing control device 94 is shown rotated through 90° about the connecting rod 40.

A resistor 98, which may take the form of a metal strip, is retained at one end 100 by an insulated retainer secured to the solenoid 81. A contact 99 is secured to the connecting member 76 in such a manner that the resistor 98 slides across it and always maintains contact with it while the connecting member 76 moves. Thus, the resistance between the resistor end 100 and the contact 99 changes as the connecting member 76 moves along the motor shaft 69, so that the position of the connecting member, which corresponds to the amount of injected fuel, can be electrically detected.

Figure 2:
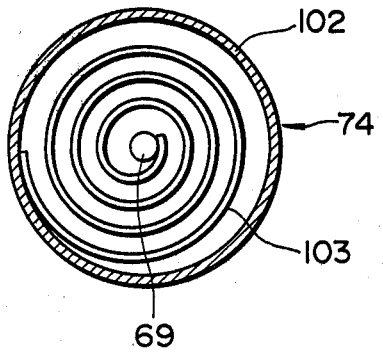
FIG. 2 is an enlarged cross-sectional view taken along the line A—A in FIG. 1.

FIG. 2 shows the urging device 74 which comprises a casing 102 and a spring 103. The casing takes a cylindrical form and could be fixed to the end wall of the motor. The spring, which takes a flat spiral form, is secured at its inner end to the motor shaft 69 and at its outer end to the inner face of the casing 102, so as to bias the motor shaft 69 circumferentially. The spring 103 returns the motor shaft to a predetermined position where the amount of injected fuel becomes small enough to maintain the engine operation safety and prevent the vehicle driven by the engine from running away, if the motor output force exerted on the motor shaft 69 disappears. The predetermined position for the motor shaft is preferably the same as that under engine idling operation or else distant from the same in the direction of reduced injected fuel.

Thus, in case the motor output force exerted on the motor shaft disappears owing to a defect occurring, such as the breaking of the lead 67 to the motor or damage of the power supply of the motor, occurring when the angular position of the motor shaft is away from the predetermined position in the direction of increased injected fuel, the motor shaft 69 is returned by the biasing force of the spring 103 and consequently the amount of injected fuel is reduced to the safety level.

Since the motor shaft 69 is normally biased in the direction of reduced injected fuel, the shaft moves quickly in that direction and therefore deceleration response of the engine is improved.

In the case where the motor 68 is feedback-controlled in response to a voltage signal representing the position of the connecting member 76 through the resistor 98, and the control changes the present voltage signal E' into a signal in the region of $E \pm \alpha$ where E is a required voltage signal, the control width $\pm \alpha$ may be decreased since the motor 68 always generates rotational force against the urging device 74 and consequently the motor shaft 69 balances at a position corresponding to the boundary voltage signal $E - \alpha$.

Figure 3:
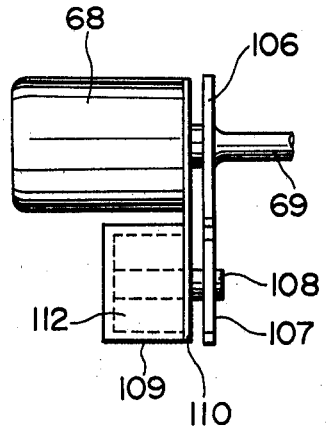
FIG. 3 is a diagrammatic sectional view of an essential portion of a second embodiment of the present invention.

FIG. 3 shows an alternative to the safety device 74 illustrated in FIG. 1 or 2. The alternative includes a first gear 106 mounted on the motor shaft 69, a second gear 107 mounted on a small shaft 108 and meshing with the first gear, a cylindrical casing 109 fixed to the end wall of the motor 68 by a plate 110, and a flat spiral spring 112 disposed in the casing 109. The ends of the spring are secured at the inner face of the casing and at the small shaft to bias the motor shaft 69 circumferentially, similarly to the safety device viewed in FIGS. 1 and 2, through the gears. Thus the alternative operates in a similar manner to the safety device shown in FIGS. 1 and 2.

It will be understood by those skilled in the art that the foregoing description is made in terms of preferred embodiments of the present invention wherein various changes and modifications may be made without departing from the spirit and scope of the invention, as set forth in the appended claims.

What is claimed is:

1. A fuel injection control system for an internal combustion engine, comprising:

(a) a housing;

(b) a fuel distributing plunger disposed within the housing and moving angularly and axially therein in synchronism with the engine, said plunger having a spill port opening outwardly;

(c) a control sleeve slidably fitted over said plunger to open and close said spill port to control the amount of fuel injected into the engine as a function of axial position of the sleeve;

(d) a reversible electric motor disposed within the housing and having a threaded motor shaft;

(e) a slider disposed within the housing in threaded engagement with the motor shaft to thereby move along the motor shaft during rotation thereof;

(f) a linkage for transmitting movement of the slider to the control sleeve through a connecting member to move the sleeve axially as the slider moves; and (g) an urging device biasing the motor shaft circumferentially to thereby rotate said shaft to a predetermined position when a motor output force exerted on the shaft stops; said predetermined position of the motor shaft being the same as that during engine idling operation;

whereby the amount of fuel injected into the engine is made small enough to maintain safe engine operation if the force exerted on the motor shaft stops due to a malfunction.

2. A fuel injection control system according to claim 1, wherein the urging device includes a casing fixed to an end wall of the motor, and a flat spiral spring secured at its inner end to the motor shaft and at its outer end to the casing.

3. A fuel injection control system according to claim 1, wherein the urging device includes a first gear mounted on the motor shaft, a rotatable urging device shaft, a second gear mounted on the urging device shaft and meshing with the first gear, a casing, a plate securing the casing to the end wall of the motor, and a flat spiral spring disposed in the casing and secured at its inner end to the urging device shaft and at its outer end to the casing.

4. A fuel injection control system for an internal combustion engine, comprising:

a housing;

(b) a fuel distributing plunger disposed within the housing and moving angularly and axially therein in synchronism with the engine, said plunger having a spill port opening outwardly;

(c) a control sleeve slidably fitted over the plunger to open and close the spill port to control the amount of fuel injected into the engine in response to the axial position of the sleeve;

(d) a reversible electric motor disposed within the housing and having a threaded motor shaft;

(e) a slider disposed within the housing in threaded engagement with the motor shaft to thereby move along the motor shaft during rotation of the shaft;

(f) a linkage for transmitting movement of the slider to the control sleeve through a connecting member to move the sleeve axially as the slider moves; and (g) an urging device biasing the motor shaft circumferentially to thereby rotate said shaft to a predetermined position when a motor output force exerted on the shaft stops the predetermined position of the motor shaft being distant from the position corresponding to engine idling in the direction of reducing injected fuel;

whereby the amount of fuel injected into the engine is made small enough to maintain safe engine operation if the force exerted on the motor shaft disappears due to a malfunction.

5. A fuel injection control system according to claim 4, wherein the urging device includes a casing fixed to an end wall of the motor, and a flat spiral spring secured at its inner end to the motor shaft and at its outer end to the casing.

6. A fuel injection control system according to claim 4, wherein the urging device includes a first gear mounted on the motor shaft, a rotatable urging device shaft, a second gear mounted on the urging device shaft and meshing with the first gear, a casing, a plate securing the casing to the end wall of the motor, and a flat spiral spring disposed in the casing and secured at its inner end to the urging device shaft and at its outer end to the casing.

7. A fuel injection control system for an internal combustion engine, comprising:

(a) a housing;

(b) a fuel distributing plunger disposed within the housing and moving angularly and axially therein in synchronism with the engine, the plunger having a spill port opening outwardly;

(c) a control sleeve slidably fitted over the plunger to open and close the spill port to control the amount of fuel injected into the engine in response to the axial position of the sleeve;

(d) a reversible electric motor disposed within the housing and having a rotatable threaded motor shaft;

(e) a slider disposed within the housing in threaded engagement with the motor shaft to thereby move along the motor shaft as the shaft rotates;

(f) a linkage for transmitting movement of the slider to the control sleeve through a connecting member to move the sleeve axially as the slider moves; and (g) an urging device biasing the motor shaft circumferentially to rotate the motor shaft to a predetermined position when a motor output force exerted on the motor shaft disappears;

said urging device including:

(1) a first gear mounted on the motor shaft;

(2) a rotatable urging device shaft;

(3) a second gear mounted on the urging device shaft and meshing with the first gear;

(4) a casing;

(5) a plate securing the case to an end wall of the motor; and (6) a flat spiral spring disposed in the casing and secured at its inner end to the urging device shaft and at its outer end to the casing.

* * * * *